US009256207B2

(12) United States Patent
Gruenig et al.

(10) Patent No.: US 9,256,207 B2
(45) Date of Patent: Feb. 9, 2016

(54) TIMEPIECE MOVEMENT PROVIDED WITH A DRIVE MECHANISM FOR THE PERIODIC OR INTERMITTENT MOVEMENT OF AN ANALOGUE INDICATOR

(71) Applicant: ETA SA Manufacture Horlogère Suisse, Grenchen (CH)

(72) Inventors: Daniel Gruenig, Sugiez (CH); Pascal Lagorgette, Bienne (CH); Julien Christan, Bienne (CH); Baptist Wyssbrod, Nidau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/666,714

(22) Filed: Mar. 24, 2015

(65) Prior Publication Data

US 2015/0286189 A1 Oct. 8, 2015

(30) Foreign Application Priority Data

Apr. 3, 2014 (EP) ..... 14163345

(51) Int. Cl.
*G04B 19/253* (2006.01)

(52) U.S. Cl.
CPC ..... *G04B 19/253* (2013.01); *G04B 19/25353* (2013.01); *G04B 19/25373* (2013.01)

(58) Field of Classification Search
CPC ..... G04B 19/253; G04B 19/25333; G04B 19/25353
USPC ..... 368/37, 38
See application file for complete search history.

(56) References Cited

U.S. PATENT DOCUMENTS 3,186,159 A 6/1965 Schneiter
3,704,583 A 12/1972 Dome
(Continued)

FOREIGN PATENT DOCUMENTS

CH 336 328 A 2/1959
CH 387 548 10/1964
(Continued)

OTHER PUBLICATIONS

EP Search Report issued in corresponding application 14163345 on Jan. 12, 2015.

*Primary Examiner* — Vit W Miska
(74) *Attorney, Agent, or Firm* — Oblon, McClelland, Maier & Neustadt, L.L.P.

(57) ABSTRACT

The timepiece movement is provided with an analog device for displaying information whose value varies periodically or intermittently, this analog display device including, on the one hand, an indicator provided with a first toothing, and on the other hand, a mechanism for the periodic or intermittent driving of the indicator. The drive mechanism is formed by an irreversible transmission system which ensures a shock resistant function for the indicator. The display device further includes a positioning jumper for the indicator generating a positioning force on the first toothing, which is sufficient to precisely position the indicator in a plurality of discrete display positions, but considerably insufficient to ensure a shock resistant function for the indicator. Thus, the indicator can be driven with a relatively low torque; which therefore requires less energy and makes it possible to provide a drive mechanism with a lower gear reduction for the drive torque transmission ratio.

6 Claims, 4 Drawing Sheets

(56) References Cited

U.S. PATENT DOCUMENTS 4,240,249 A * 12/1980 Malkin ..... G04B 19/25373 368/221
4,261,047 A * 4/1981 Nakao ..... G04B 19/25353 368/37
4,372,687 A * 2/1983 Krasovsky ..... G04B 19/25373 368/221
4,837,755 A 6/1989 Besson
6,097,672 A * 8/2000 Kitahara ..... G04B 19/25353 368/35

FOREIGN PATENT DOCUMENTS

FR 2 124 471 A1 9/1972
FR 2 615 970 A1 12/1988

* cited by examiner

TIMEPIECE MOVEMENT PROVIDED WITH A DRIVE MECHANISM FOR THE PERIODIC OR INTERMITTENT MOVEMENT OF AN ANALOGUE INDICATOR

This application claims priority from European patent application No. 14163345.3 filed Apr. 3, 2014, the entire disclosure of which is hereby incorporated herein by reference.

FIELD OF THE INVENTION

The present invention concerns the field of timepiece movements including an analogue display of information whose value varies periodically or intermittently among predefined discrete values, in particular calendar information and/or a function/application selected from a plurality of possible functions/applications. "Value" generally means a number, calendar information (such as the date, the day of the week or the month) and also the selection of a function or an application from a plurality of functions or applications, although this list is not exhaustive. The invention particularly concerns the drive mechanism for the periodic or intermittent movement of an analogue indicator, and the shock resistant means of such indicator, in addition to the precise positioning of the indicator in each display position of a plurality of proposed discrete display positions.

BACKGROUND OF THE INVENTION

There are mainly three known types of mechanism for driving a calendar indicator, in particular a date ring: a continuous mechanism, a conventional semi-instantaneous mechanism and an instantaneous mechanism.

In a conventional variant shown in FIG. 1, the continuous mechanism 2 is arranged to drive a date ring 4 provided with an inner toothing 6. This continuous mechanism includes a Maltese cross 8 and a wheel set 12 for actuation thereof. The Maltese cross includes six branches 9 and is integral with a coaxial pinion 10 which meshes with the date ring toothing 6. Pinion 10 has six teeth. The number of branches of the Maltese cross and the number of teeth of the pinion are given here by way of non-limiting example. Thus, there is also a known mechanism of this type having a Maltese cross with four branches and a pinion with eight teeth. Preferably, the ratio between the number of teeth and the number of branches is an integer number. Actuation wheel set 12 includes two drive pins 16, 17 and a locking member 14 which cooperates with branches 9 to lock the Maltese cross in stable positions between two successive drive operations respectively performed by the two pins. This actuation wheel set is driven in rotation, for example, by a pinion 20. As the operation of a Maltese cross system is well known, it will not be described in more detail here.

The continuous drive mechanism described above is characterized by a gear with little or no play, and by the absence of a jumper spring. Thus, the driving function and the function of positioning the date ring in its display positions are both performed by the pinion associated with the Maltese cross. Moreover, the shock-resistant function is performed by the Maltese cross system, as the locking member 14 easily ensures this function. The manufacture of a timepiece movement with this type of mechanism is expensive since it it necessary to reduce to a maximum the machining and assembly tolerances (manufacturing tolerances) of the mechanism and of the date ring, to ensure precise positioning of the ring in its display positions, for example precise centering of each date in the aperture of a dial provided for the timepiece movement.

The conventional semi-instantaneous drive mechanism includes a drive wheel for the date ring generally provided with one finger-piece or two finger-pieces which periodically penetrate(s) the ring toothing to drive it from one display position to the next. The spaces between the teeth of this toothing are generally made relatively wide, in particular to allow each finger-piece to enter and exit the ring toothing with no risk of locking; especially because of the manufacturing and centering tolerances of the date ring. Thus, it is clear that the drive wheel cannot ensure the function of positioning the ring. Further, it cannot ensure a shock resistant function, since generally there is no meshing between the toothing and the finger-piece, respectively the two finger-pieces, over a certain range of angles of the drive wheel.

To ensure the positioning function and the shock resistant function, there is provided a jumper-spring, also called a "jumper", which is inserted between two successive teeth of the ring toothing. This is referred to as a semi-instantaneous system since, in a first phase of the change to the next date, the ring is driven in rotation by a finger-piece of the drive wheel and the tip of the tooth downstream of the jumper lifts the jumper until the tip of the jumper is resting against the tip of the tooth. Next, the jumper exerts a tangential force on the rear flank of the tooth concerned and then takes its next rest position. In this second phase, the jumper rapidly drives the date ring in rotation to its next display position, the finger-piece of the drive wheel continuing its rotation at a lower speed than the ring and thus ceasing to exert a torque force on the ring. The space between the teeth is arranged to be sufficiently large so that the tooth following the tooth pushed by a finger-piece does not abut against the finger-piece inserted into the ring toothing. A major drawback of this semi-instantaneous mechanism arises from the fact that the shock resistant function is accomplished by the jumper, which therefore has to press on the date ring with significant force in order to exert sufficient locking torque in the event of a shock. Thus, at each change of date, the drive mechanism must provide a large drive torque to overcome the positioning torque of the jumper; which requires a great deal of energy and a mechanism capable of providing such a drive torque at the date ring toothing.

There exist several embodiments of an instantaneous drive mechanism. In each case there is provided a positioning jumper that also ensures the shock resistant function. This mechanism therefore has the same drawbacks as the semi-instantaneous mechanism described above.

SUMMARY OF THE INVENTION

It is an object of the present invention to overcome the problems and drawbacks of prior art drive mechanisms for the periodic or intermittent movement of an analogue indicator, in particular of a date ring.

To this end, the present invention concerns a timepiece movement provided with an analogue device for displaying information whose value varies periodically or intermittently, this analogue display device including, on the one hand, an indicator of said information provided with a first toothing, and on the other hand, a mechanism for the periodic or intermittent driving of the indicator. This drive mechanism is formed by an irreversible transmission system including a second toothing which meshes with the first toothing. The display device further includes an indicator positioning jumper generating a positioning force on the first toothing, this positioning force being sufficient to precisely position the indicator in a plurality of discrete display positions, but insufficient to ensure a shock resistant function for the indicator. Further, the tangential play between the first and second toothings is arranged to be sufficiently large so that the first and second toothings do not touch each other when the indicator is in any one display position of a plurality of discrete display positions and the irreversible transmission system is in a corresponding predefined position. This irreversible transmission system ensures a shock resistant function for the indicator by means of the meshing of the first and second toothings at least when the indicator is in any one display position of a plurality of discrete display positions and the irreversible transmission system is in said corresponding predefined position.

"Periodic driving" means driving that occurs only periodically, that is to say the driving occurs periodically during a limited time interval and that no driving occurs between the limited time intervals. Likewise, "intermittent driving" means discontinuous driving which stops and starts according to the command of the intermittent drive mechanism without the driving necessarily occurring at regular intervals.

As a result of the features of the timepiece movement according to the invention, the problem of the continuous mechanism described above, with the Maltese cross system driving and positioning the indicator, and the problem of the conventional semi-instantaneous or instantaneous mechanism, where a jumper spring ensures the positioning of the indicator and the shock resistant function, are both resolved. In a particular embodiment of the invention, the drive mechanism defines a mechanism similar to a semi-instantaneous mechanism with one or more finger-pieces for driving the indicator integral with a Maltese cross, the finger-piece or finger-pieces forming the aforementioned second toothing. Indeed, the positioning jumper is generally also used for driving the indicator in a second phase of changing the indicator from one display position to a following display position.

According to the invention, the indicator drive function, at least in a first phase of changing the indicator from one display position to a following display position, and the shock resistant function are ensured by the irreversible transmission system, which is capable of exerting a very high locking force. However, the positioning function is not ensured by this irreversible transmission system as in the prior art, but by a positioning jumper exerting a force sufficient for this function but much lower than the ordinary minimal force for locking the indicator in the event of a shock.

Thus, on the one hand, it is possible to drive the indicator from one display position to another with a drive torque that is much lower than the prior art embodiments having a conventional semi-instantaneous or instantaneous mechanism, in which the jumper spring must be able to exert a large tangential force on the indicator toothing in the event of a shock. On the other hand, the tolerance and assembly problems of a prior art embodiment having a continuous mechanism but no jumper spring are eliminated.

Other particular features of the invention will be set out below in the detailed description of the invention.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
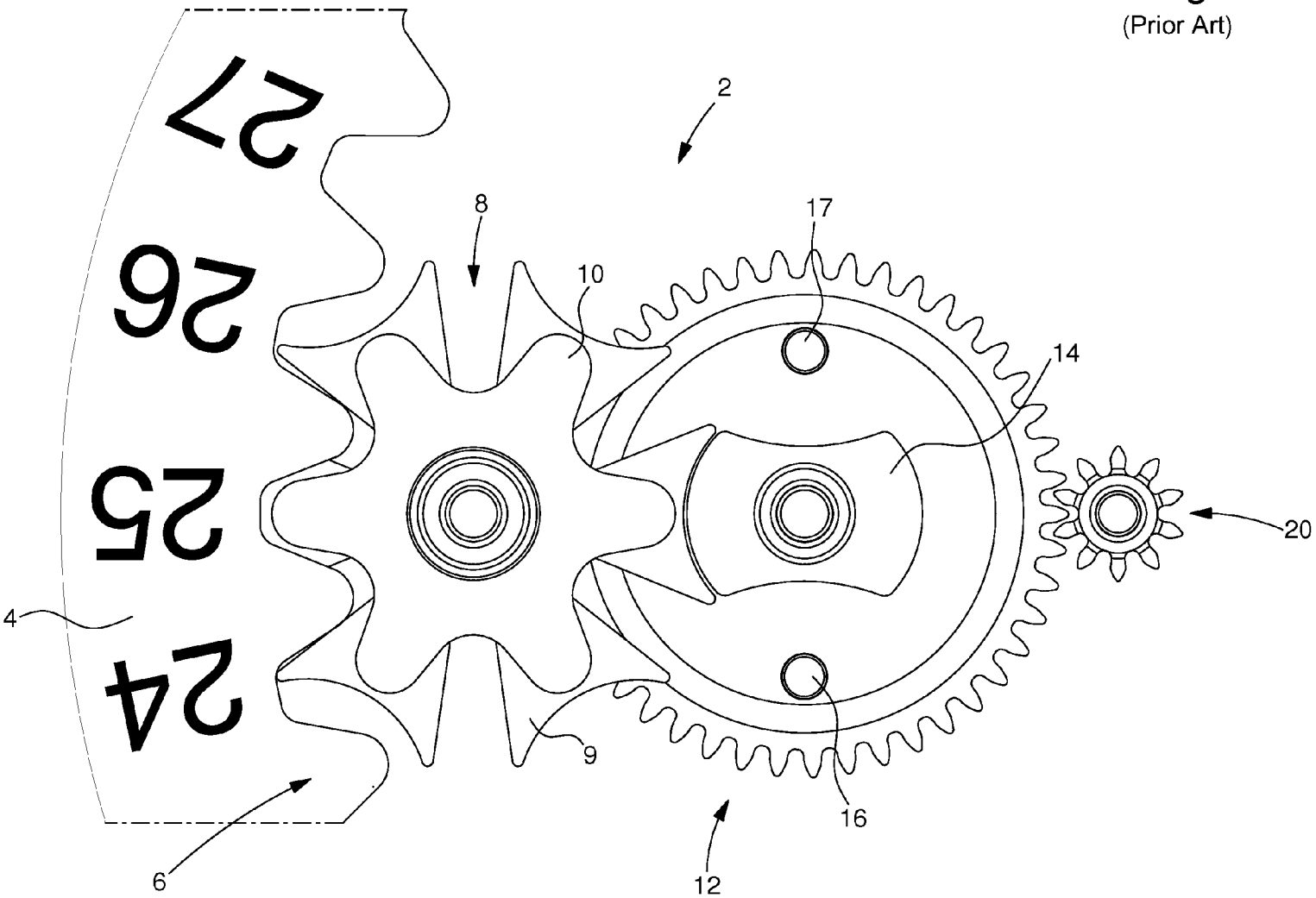
Fig. 1 (Prior Art)
FIG. 1, already described, is a top view of a prior art continuous drive mechanism with a Maltese cross system.
Figure 2A:
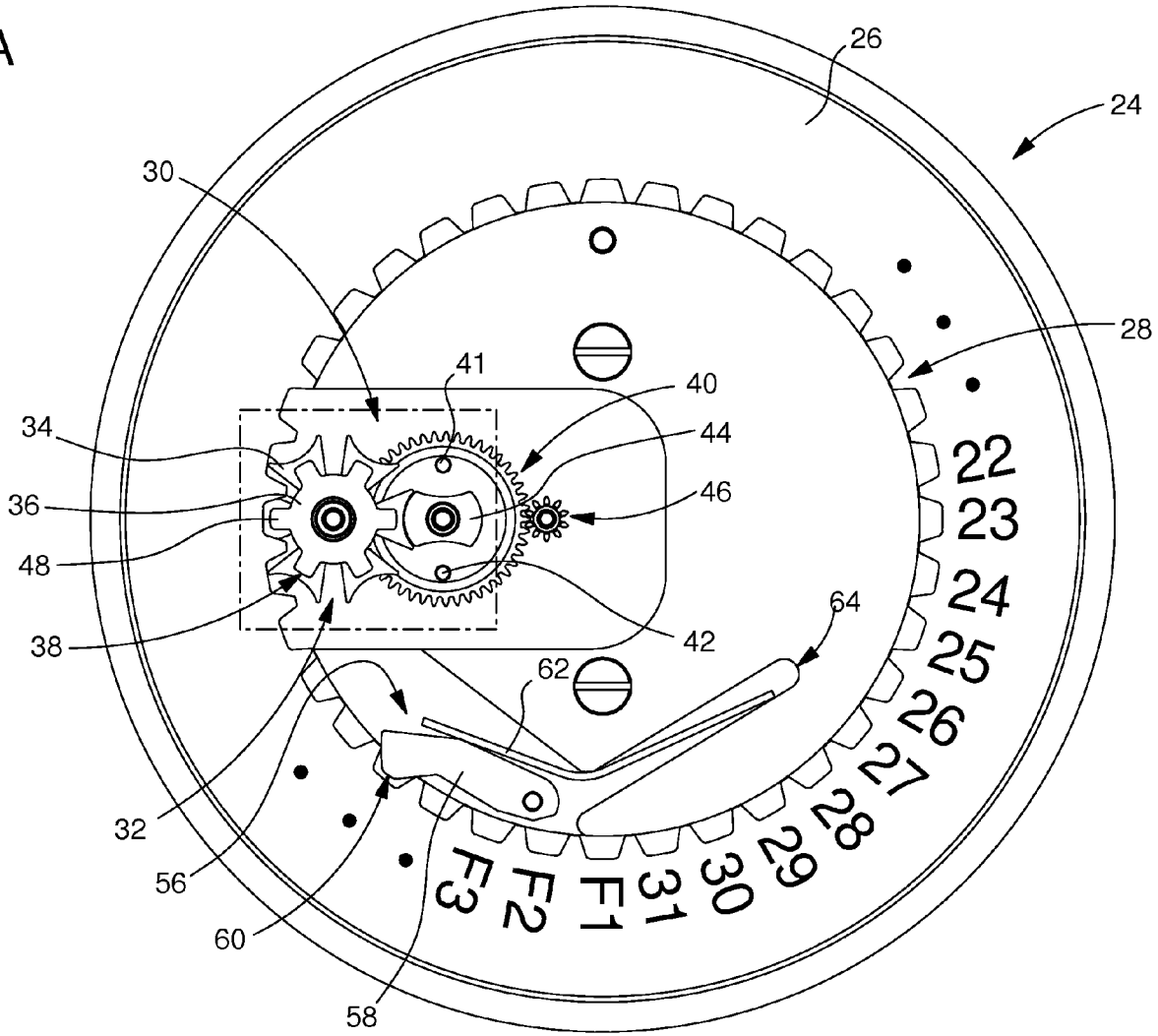
FIG. 2A is a schematic top view of a first embodiment of a timepiece movement according to the invention.
Figure 2B:
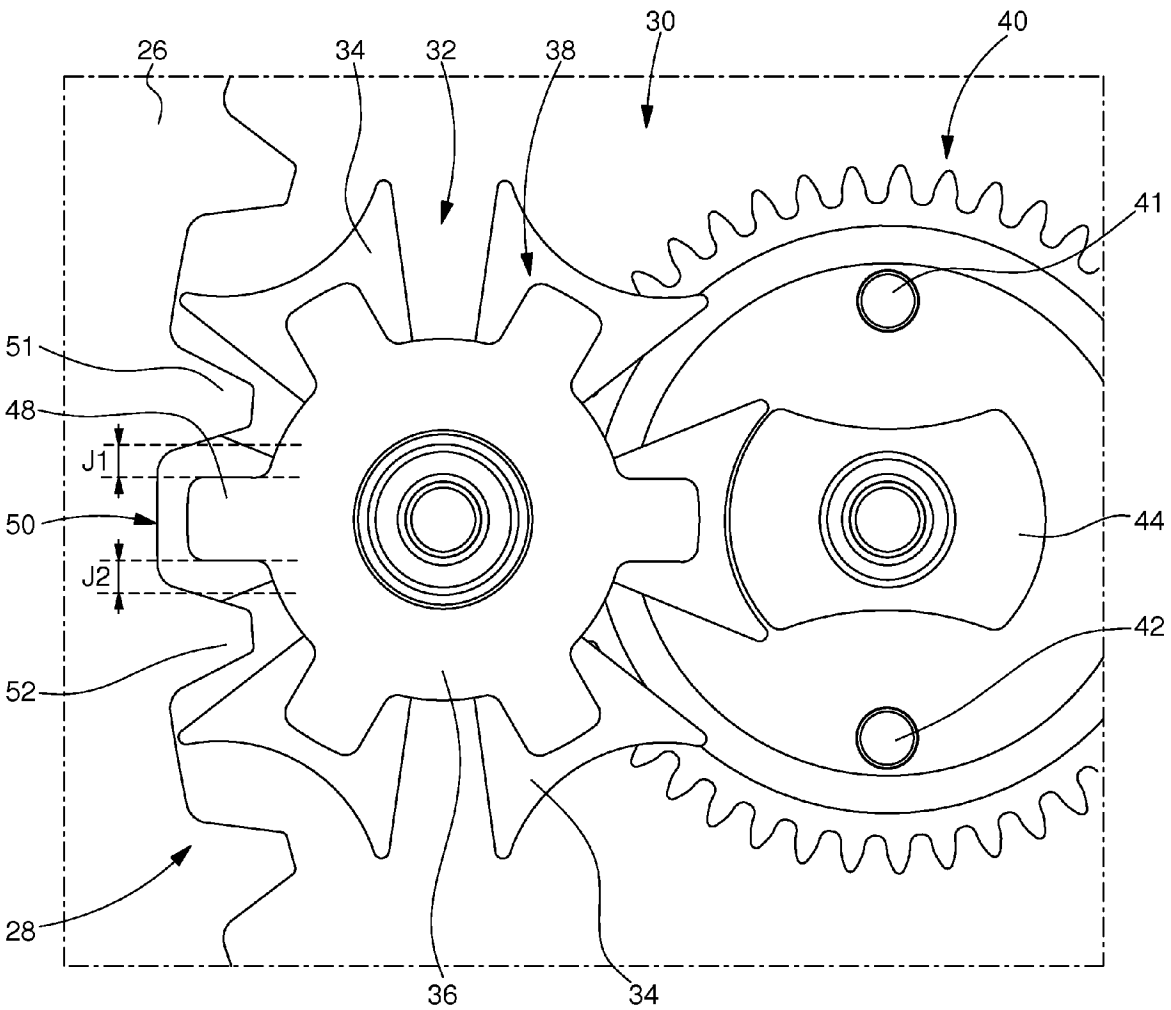
FIG. 2B is a partial enlargement of the view of FIG. 2A showing the meshing between the toothing of a date ring and a Maltese cross system of the first embodiment.

With reference to FIGS. 2A and 2B, a first embodiment of a timepiece movement according to the invention will be described below. The timepiece movement 24 is provided with a device for the analogue display of the date, which is periodically varying information, and of various functions F1, F2, etc., which can be selected by a user of a watch provided with the timepiece movement. This analogue display device includes a ring 26 provided with a first toothing 28 and a drive mechanism 30. The various dates "1" to "31" and the name of the various possible functions are printed on ring 26. Each date and each function defines a discrete display position of ring 26 through an aperture provided in a dial mounted on timepiece movement 24. The driving is periodic for the date and intermittent for the selection of a function from the plurality of possible functions.

Drive mechanism 30 is formed by a Maltese cross system defining an irreversible transmission system. It includes a drive wheel 32 with a Maltese cross 34 surmounted by a pinion 36, which has a second toothing 38 that meshes with first toothing 28. To actuate the drive wheel in a periodic or intermittent manner, the drive mechanism further includes an actuation wheel 40 driven by a pinion 46, which is itself driven in rotation by an electromagnetic motor (not shown). The actuation wheel includes two pins 41 and 42 aligned on a diameter of the actuation wheel and a locking member 44 centred on this axis of rotation. The pins are arranged to penetrate between the branches of the Maltese cross and to permit driving of wheel 32 and thus of the independent date ring. Locking member 44 is used for locking wheel 32 through the positioning thereof in any one of the curved ends of the branches of the Maltese cross.

The Maltese cross system thus defines an irreversible transmission, since the actuation wheel can drive the drive wheel in rotation, but not vice versa. Regardless of the angular position of the actuation wheel, a torque force transmitted by the drive wheel to the actuation wheel will cause rotation of the latter over at most a small angular distance. This is also referred to as a self-locking drive mechanism, since, by design, it stops transmission of a torque force and therefore a rotation in the opposite direction to the intended direction. In the discrete display positions, it is preferably provided that locking member 44 is substantially aligned on the end of one branch of the Maltese cross (as shown in FIGS. 2A and 2B), so as to prevent any rotation of the Maltese cross (beyond manufacturing tolerances). Thus, at least when ring 26 is in any one display position of its plurality of discrete display positions and the Maltese cross system is in the corresponding position defined above, a torque force exerted by the ring on pinion 36 will not drive wheel 40 in rotation.

According to the invention, there is tangential play between first toothing 28 and second toothing 38, substantially equal to J1+J2 as shown in FIG. 2B. This tangential play is made sufficiently large so that the first and second toothings do not touch each other when ring 26 is in any one display position of the aforementioned plurality of discrete display positions and the Maltese cross is in a corresponding predefined position, preferably that shown in FIGS. 2A and 2B. Regardless of the angular position of pinion 36, the first and second toothings are always in a meshing situation. Thus, an inadvertent jump of the independent date ring is never possible in the event of a shock. Indeed, even if the ring is subjected to an acceleration due to a shock when being driven by pinion 36, tooth 48 will always be in a space 50 arranged between two adjacent teeth 51 and 52 of toothing 28 once the driving has finished and the Maltese cross system has returned to a non-driving position provided for the plurality of discrete display positions. Thus, at least when the Maltese cross system is in an intended non-driving position, pinion 36 remains immobile if a significant torque force is exerted thereon by ring 26. This ring can therefore only move within the aforementioned tangential play when it is in any one display position of the plurality of discrete display positions. The Maltese cross system thus ensures a shock resistant function for ring 26 by means of the meshing of the first and second toothings. "Shock resistant function" does not mean the fact of preventing the mechanism breaking or being damaged in the event of a shock, but of preventing the indicator from changing discrete display position in a lasting manner under the effect of a shock to which the watch may be subjected without breaking (In accordance with NIHS 91-10, 91-20, 91-30 and other standards).

For precisely positioning the independent date ring, the display device further includes a positioning jumper 56 for the ring. The jumper, also known as a jumper-spring, is formed of an arm 58, having a positioning tooth 60 at a first end and pivoting about an axis at the other end, and of a spring 62 which exerts a force on the arm to generate a positioning force on first toothing 28. When the ring moves away from a display position and the jumper from a corresponding stable or rest position, this positioning force has a tangential component acting on the ring toothing either to return the ring to its display position, if there is no change of discrete display position, or to move the ring, in an end phase, into another intended display position during actuation of the ring drive device. By way of example, spring 62 is a curved elastic pin or strip with one portion in a groove 64 and the other portion resting against the rear lateral surface of arm 58. According to the invention, the positioning force is sufficient to precisely position ring 26 in a plurality of discrete display positions but insufficient to ensure a shock resistant function for the ring. The positioning force is therefore arranged to be lower than an ordinary minimum force for locking the ring in the event of a shock, so as to enable the ring to be driven in rotation with a relatively low torque force and therefore to minimise the energy required for the change from one display position to another. In a preferred variant, the positioning force is, on the one hand, higher than a maximum friction force exerted by the timepiece movement on ring 26 and, on the other hand, less than three times this maximum friction force.

By way of non-limiting example, it was observed that a conventional date ring made of brass with a diameter of 20 mm requires a torque of around 60 μNm to overcome the static friction force on the ring when the movement is placed flat. To ensure a shock resistant function with the jumper, as is the case in the aforementioned prior art movements, the jumper must, in this example, be able to exert a locking torque force of around 2000 μNm. For an aluminium or plastic ring, given the lower weight, this shock resistant torque will be less, for example, than around 800 μNm. However, as a result of the invention, in the case of a steel ring, it is possible, in a variant, to size spring 62 so that jumper 56 exerts a torque of between 120 μNm and 180 μNm. With the aluminium or plastic ring, the torque exerted by jumper 56 will be, for example, between 80 μNm and 120 μNm. It is thus observed that the present invention can greatly reduce the torque exerted by the jumper on the ring and thus the drive torque required to be transmitted by drive mechanism 30. In particular, it is possible to reduce the gear reduction ratio in the drive mechanism.

According to a preferred variant, the tangential play between the first and second toothings is arranged to be greater than or substantially equal to twice the cumulative manufacturing tolerances occurring in the gear formed by ring 26 and Maltese cross wheel 32 at first and second toothings 28 and 38.

In a specific variant, the play between the first and second toothings is arranged to be less than the maximum distance over which the jumper, moved away from a stable rest position, corresponding to a display position, by a movement of the indicator, is capable of returning the indicator to this stable rest position by the positioning force that it exerts on the indicator toothing. In another variant, it is the half play plus the cumulative manufacturing tolerances occurring in the gear formed by the indicator and irreversible transmission system at the first and second toothings, which is less than the maximum distance defined above. In this variant, the theoretical position of the second toothing of the irreversible transmission system, for the discrete indicator display positions, is substantially centred in the first toothing of the indicator; that is to say that the play is substantially distributed in equal parts on both sides of the tooth or teeth of the second toothing inserted in the first indicator toothing, as is the case in FIG. 2B. It will be noted that the jumper may also have some tolerance as regards the display positions that it defines by its stable rest positions in the first toothing. This tolerance is advantageously added to the cumulative manufacturing tolerances occurring in the aforementioned gear to define the play to be provided in the variants presented above. In a preferred variant, the position of the jumper may be adjusted after assembly of the indicator, so that the discrete display positions are predefined in a very precise manner and the positioning tolerance of the jumper may be disregarded.

Figure 3B:
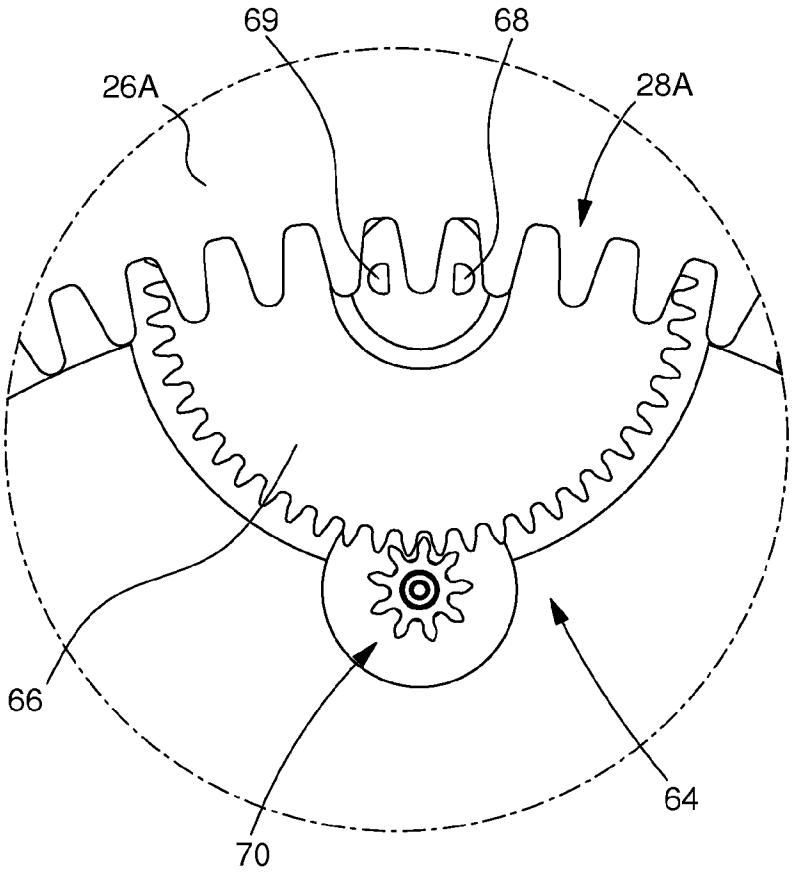
FIGS. 3A and 3B show partial and respectively perspective and top views of a second embodiment of a timepiece movement according to the invention.
Figure 3A:
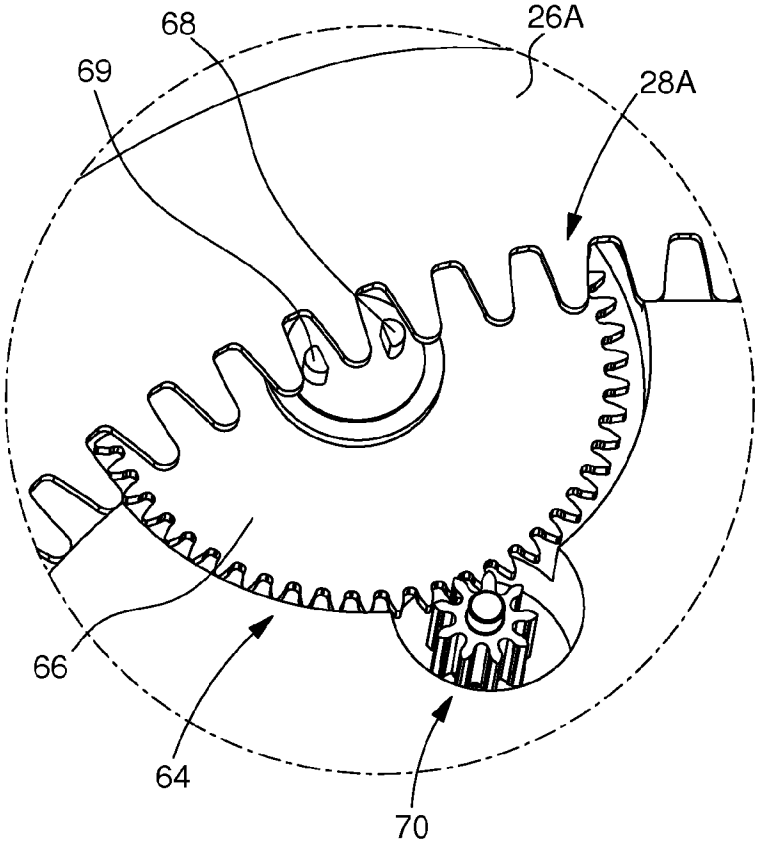

FIGS. 3A and 3B partially show a second embodiment of a timepiece movement according to the invention. The aforementioned different variants which may also be provided in this second embodiment will not be described again here. The second embodiment is characterized by a drive mechanism having a self-locking pin system instead of the Maltese cross system of the first embodiment. In the variant shown, drive mechanism 64 for a date ring 26A includes a drive wheel 66 to which are fixed two pins 68 and 69, which define a second toothing in the gear formed by ring 26A and wheel 66. This wheel is driven by a pinion 70 associated with or coupled to an electromagnetic motor. The two pins are aligned on a diameter of wheel 66. Thus, in the position shown in FIGS. 3A and 3B, which corresponds to the position of wheel 66 arranged in the discrete display positions of the date ring, these two pins ensure total locking of the date ring. Indeed, a torque force applied by the ring to wheel 66 will not be able to drive the wheel in rotation; the wheel thus forms, with its two pins, an irreversible transmission system.

Preferably, the two pins are not cylindrical, but have a substantially semi-circular cross-section in order to obtain a relatively large play between first toothing 28A and the second toothing formed of these two pins, while providing a gear that does not lock. Indeed, when the date ring is driven, each pin must be able to alternately exit from a space of toothing 28A and then enter another space of this toothing without abutting against the tip of a tooth. The other features already described with reference to the first embodiment will not be repeated here. In particular, a jumper-spring, similar to that of the first embodiment, is arranged to precisely position the date ring in a plurality of discrete display positions.

Finally, it will be noted that other embodiments may be provided by those skilled in the art for creating an irreversible transmission system. Irreversibility may be considered within the range of torque forces that may occur in the wheel meshing with the indicator, particularly with the date ring toothing, in the event of a shock or violent movement. It is thus sufficient for irreversibility to be obtained up to a maximum torque force generated by the indicator in the wheel in every situation that the watch provided with the timepiece movement according to the invention might encounter. A particular embodiment concerns an electronic movement including an electromagnetic motor arranged to actuate the indicator drive mechanism. In the case of a stepping motor, the stator is arranged to generate a positioning torque applied to the permanent magnet rotor of the motor, which may be increased by a short-circuit of the coil, particularly in the case of a Lavet motor. This positioning torque holds the rotor in at least one stable rest position (position taken in the absence of electrical power). The motor can be configured so that the positioning torque of the rotor transmitted to the wheel meshing with the indicator defines a locking torque which is higher than the maximum torque force that the indicator can exert on the wheel, particularly in the event of a shock. Preferably, the gear reduction ratio of the kinematic chain of the drive mechanism is relatively high so that the locking force is sufficiently high. It will be noted that the locking torque obtained depends not only on the positioning torque and on the reduction factor of the kinematic chain, but also on friction losses in the kinematic chain.

What is claimed is:

1. A timepiece movement provided with an analogue device for displaying information whose value varies periodically or intermittently, said analogue display device including, on the one hand, an indicator of said information provided with a first toothing and, on the other hand, a mechanism for the periodic or intermittent driving of said indicator, said drive mechanism being formed by an irreversible transmission system including a second toothing which meshes with said first toothing, wherein the display device further includes a positioning jumper for said indicator generating a positioning force on the first toothing that is sufficient to precisely position the indicator in a plurality of discrete display positions but insufficient to ensure a shock resistant function for the indicator; wherein, between the first and second toothings there is a tangential play which is arranged to be sufficiently large so that the first and second toothings do not touch each other when the indicator is in any one display position of said plurality of discrete display positions and the irreversible transmission system is in a corresponding predefined position; and wherein the irreversible transmission system ensures a shock resistant function for the indicator through the meshing of the first and second toothings at least when said indicator is in any one display position of said plurality of discrete display positions and the irreversible transmission system is in said corresponding predefined position.

2. The timepiece movement according to claim 1, wherein the irreversible transmission system is a Maltese cross system.

3. The timepiece movement according to claim 1, wherein the irreversible transmission system is a self-locking pin system.

4. The timepiece movement according to claim 1, wherein said positioning force is higher than a maximum friction force exerted by the timepiece movement on said indicator, and wherein this positioning force is less than three times said maximum friction force.

5. The timepiece movement according to claim 1, wherein said tangential play between the first and second toothings is greater than or substantially equal to two times the cumulative manufacturing tolerances occurring in the gear formed by the indicator and the irreversible transmission system at the first and second toothings.

6. The timepiece movement according to claim 1, wherein said indicator is a date ring.

* * * * *